US009719366B2

(12) United States Patent
Yu et al.

(10) Patent No.: US 9,719,366 B2
(45) Date of Patent: Aug. 1, 2017

(54) METHODS AND SYSTEMS FOR BLADE HEALTH MONITORING

(71) Applicant: General Electric Company, Schnectady, NY (US)

(72) Inventors: Lijie Yu, Atlanta, GA (US); Venkatesh Rajagopalan, Bangalore Karnataka (IN); Sachin Srivastava, Bangalore Karnataka (IN); Mayank Lalan, Bangalore Karnataka (IN)

(73) Assignee: General Electric Company, Schnectady, NY (US)

( * ) Notice: Subject to any disclaimer, the term of this patent is extended or adjusted under 35 U.S.C. 154(b) by 1062 days.

(21) Appl. No.: 13/916,179

(22) Filed: Jun. 12, 2013

(65) Prior Publication Data

US 2014/0369833 A1 Dec. 18, 2014

(51) Int. Cl.

| | |
|---|---|
| ***F01D 11/14*** | (2006.01) |
| ***F01D 11/20*** | (2006.01) |
| ***F01D 17/02*** | (2006.01) |
| ***F01D 21/00*** | (2006.01) |
| ***F01D 21/04*** | (2006.01) |
| ***F01D 21/10*** | (2006.01) |
| ***F01D 21/14*** | (2006.01) |

(52) U.S. Cl.

CPC ..... *F01D 11/14* (2013.01); *F01D 11/20* (2013.01); *F01D 17/02* (2013.01); *F01D 21/003* (2013.01); *F01D 21/04* (2013.01); *F01D 21/045* (2013.01); *F01D 21/10* (2013.01); *F01D 21/14* (2013.01)

(58) Field of Classification Search

CPC ..... F01D 11/14; F01D 11/20; F01D 17/02; F01D 21/003; F01D 21/04; F01D 21/045; F01D 21/10; F01D 21/14

See application file for complete search history.

(56) References Cited

U.S. PATENT DOCUMENTS 7,392,713 B2 * 7/2008 Barkhoudarian ..... F01D 21/003 324/160
7,455,495 B2 * 11/2008 Leogrande ..... F01D 11/24 415/1

(Continued)

FOREIGN PATENT DOCUMENTS

WO WO2011064490 A1 * 6/2011

*Primary Examiner* — Dwayne J White
*Assistant Examiner* — Adam W Brown
(74) *Attorney, Agent, or Firm* — Eversheds-Sutherland (US) LLP

(57) ABSTRACT

Systems and methods for blade health monitoring are provided. According to one embodiment of the disclosure, a system may include a feature extraction module and an anomaly detection module in communication with the extraction module. The feature extraction module may be configured to continuously receive blade passing signal data associated with clearance of a blade and pre-process the blade passing signal data. Blade clearance feature data may be extracted from the blade passing signal data prior to transmission to the anomaly detection module. The anomaly detection module may be configured to normalize the blade clearance feature data received from the extraction module, analyze the blade clearance feature data to detect a shift in the clearance of the blade, and determine an abnormality of the blade based on the shift exceeding a predetermined shift threshold.

20 Claims, 6 Drawing Sheets

(56) References Cited

U.S. PATENT DOCUMENTS

| | | | | |
|---|---|---|---|---|
| 8,164,761 | B2 * | 4/2012 | Kominsky | F01D 11/20 250/559.22 |
| 9,097,575 | B2 * | 8/2015 | Gerez | G01H 1/006 |
| 9,250,153 | B2 * | 2/2016 | Prabhu | G01M 5/0083 |
| 2010/0161154 | A1 * | 6/2010 | Moeckly | F01D 21/003 701/3 |
| 2011/0213569 | A1 * | 9/2011 | Zielinski | F01D 21/003 702/38 |

* cited by examiner

METHODS AND SYSTEMS FOR BLADE HEALTH MONITORING

TECHNICAL FIELD

This disclosure relates generally to monitoring systems and, more particularly, to methods and systems for monitoring health of a gas turbine compressor blade.

BACKGROUND

Rotating blades are used in many devices such as compressors, turbines, and engines. An axial compressor, for example, has a series of stages with each stage comprising a row of rotor blades followed by a row of stator blades. Various factors may adversely affect rotor blade health and lead to fatigue, stress, and, ultimately, damage. These factors may put a device, such as a turbine compressor, at risk of causing permanent damage to rotating and/or stationary blades, sometimes even resulting in catastrophic failures (e.g., rotor blade liberation). To prevent failures, vibration and performance data systems may be used. However, the vibration and performance data systems provide little or no sensitivity to blade damage in case of material cracking or minor material loss.

BRIEF DESCRIPTION OF THE DISCLOSURE

The present disclosure relates to methods and systems for blade health monitoring. According to one embodiment of the disclosure, a method is provided. The method may include continuously receiving blade passing signal data associated with a clearance of a blade from an extraction module. The blade passing signal data may be pre-processed by the extraction module. The method may further include extracting blade clearance feature data from the blade passing signal data, normalizing the blade clearance feature data, detecting a shift in the clearance of the blade based on the blade clearance feature data, evaluating the shift in the clearance of the blade, and determining an abnormality of the blade based on the shift exceeding a predetermined shift threshold.

In another embodiment of the disclosure, a system is provided. The system may include a feature extraction module and an anomaly detection module in communication with the extraction module. The feature extraction module may be configured to continuously receive blade passing signal data associated with a clearance of a blade, and pre-process the blade passing signal data. Blade clearance feature data may be extracted from the blade passing signal data prior to transmission to the anomaly detection module. The anomaly detection module may be configured to normalize the blade clearance feature data received from the extraction module, analyze the blade clearance feature data to detect a shift in the clearance of the blade, and determine an abnormality of the blade based on the shift exceeding a predetermined shift threshold.

In yet another embodiment of the disclosure, a further system is provided. The system may include a gas turbine compressor including a plurality of blades, a plurality of magnetic sensors to sense blade passing signals from the plurality of blades, an extraction module, and an anomaly detection module in communication with the extraction module. The extraction module may be configured to continuously receive blade passing signal data associated with a clearance of the blades, and pre-process the blade passing signal data. Blade clearance feature data may be extracted from the blade passing signal data prior to transmission to the anomaly detection module. The anomaly detection module may be configured to normalize the blade clearance feature data received from the extraction module, analyze the blade clearance feature data to detect a shift in the clearance of the blade, determine an abnormality of the blade based on the shift exceeding a predetermined shift threshold, assess a confidence level of the shift, and selectively declare an alarm condition based on the confidence level.

Other embodiments and aspects will become apparent from the following description taken in conjunction with the following drawings.

DETAILED DESCRIPTION

Figure 1:
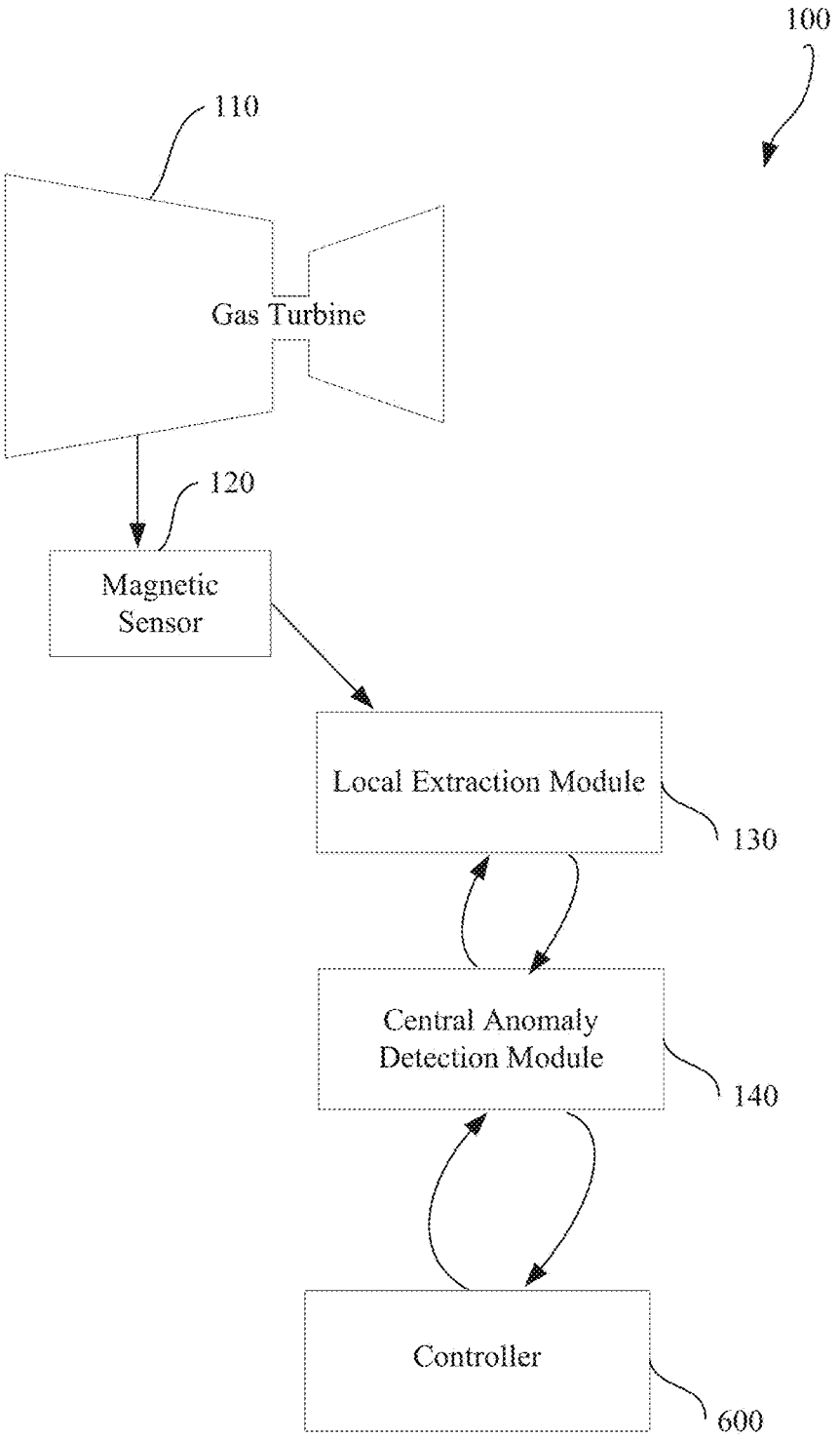
FIG. 1 is a block diagram illustrating an example system environment for blade health monitoring in a gas turbine, in accordance with an embodiment of the disclosure.

The following detailed description includes references to the accompanying drawings, which form part of the detailed description. The drawings depict illustrations, in accordance with example embodiments. These example embodiments, which are also referred to herein as "examples," are described in enough detail to enable those skilled in the art to practice the present subject matter. The example embodiments may be combined, other embodiments may be utilized, or structural, logical, and electrical changes may be made, without departing from the scope of the claimed subject matter. The following detailed description is, therefore, not to be taken in a limiting sense, and the scope is defined by the appended claims and their equivalents.

The embodiments described herein relate to methods and systems for blade health monitoring. Certain embodiments can provide for blade health monitoring by detecting a shift in clearance of a blade of a turbine compressor, thus detecting an abnormality that may be associated with blade damage. In compressors, rotating blades are relatively important components working in adverse environments. Various events, such as damage due to foreign objects, rubbing, crack induced tip clearance shifting, and the like, may cause blade material loss or blade deformation that may lead to blade failure. Blade clearance may be monitored in order to detect blade damage and prevent blade failures. Blade clearance data may be used to detect shifts in blade clearance and declare an alarm for detected shifts in the blade clearance.

However, some detected shifts may be associated with minor blade damage that does not present a failure hazard.

To eliminate or otherwise minimize declaring alarms for such minor damages, various statistical and evaluation processes may be applied. Such processes may include determining that a shift exceeds a predetermined threshold, evaluating repeated shift events, assessing a shift confidence level, and so forth.

A system for blade health monitoring may have a distributed architecture to reduce the cost of the system and improve blade detection. Whereas blade clearance may be monitored directly with some pre-processing of the monitoring data, further processing of the data and applying statistical and evaluation processes to detect anomalies may be performed centrally, for example, by a stand-alone device that may be coupled to a turbine controller, or by the turbine controller itself.

The technical effects of certain embodiments of the disclosure may include improving detection of blade abnormalities, thus improving prevention of compressor failures. Further technical effects include reduction in costs for transferring high frequency signal data due to a distributed architecture (a local extraction module and a central anomaly detection module). The local module may preprocess the signal data and extract data related to step changes in the signal data, so that the volume of data transferred to the central anomaly detection module is reduced. Yet further technical effects are due to statistical processing and confidence evaluation of detected step changes that may reduce false alarm rates and provide for overall improvement of prevention and/or minimization of compressor failures.

The following provides the detailed description of various example embodiments related to systems and methods for blade health monitoring.

Referring now to FIG. 1, a block diagram illustrates a system environment 100 suitable for implementing a method for blade health monitoring, in accordance with one or more example embodiments. In particular, the system environment 100 may comprise a gas turbine 110, a magnetic sensor 120, a feature extraction module or a local extraction module 130, a central anomaly detection module 140, and a controller 600.

The magnetic sensor 120 may be coupled to the gas turbine 110. For example, the magnetic sensor 120 may be installed in a wall of a compressor of the gas turbine 110. The magnetic sensor 120 may continuously sense blade passing signals that are indicative of clearance of the blade. Tip clearance may be approximated based on the peak voltage of each blade passing signal. The blade passing signal may be continuously received by the local extraction module 130, which may extract the blade feature data from the blade passing signal. In some embodiments, raw blade passing signals may be smoothed using a low pass filter.

The local extraction module 130 may then transmit the extracted blade feature data to the central anomaly detection module 140, which may normalize the blade feature data to further improve a signal-to-noise ratio. Thereafter, the data may be analyzed to detect a shift in the clearance of the blade. A shift exceeding a certain predetermined threshold may be declared an abnormality of the blade, such as a blade cracking, a blade deformation, a blade rubbing, a blade liberation, a blade material loss, and the like. In some embodiments, determination of abnormalities may trigger an alarm. In other embodiments, alarms may be triggered when certain conditions are met. One such condition may be a confidence level associated with the detected shifts. The confidence level may be assessed, for example, based on a two sample T-Test applied to data sets before and after the shift. Alarms may be triggered only for shifts with a confidence level exceeding a predetermined value.

Additionally, the determined abnormalities may be further analyzed for persistence. For example, a number of times the abnormality is repeated may be analyzed, and alarm triggering may be omitted for non-recurring abnormalities. Furthermore, to avoid repetitive declarations of alarms, the central anomaly detection module 140 may suppress triggering an alarm for the same abnormality for a predetermined period of time after the alarm was first triggered.

Referring now back to FIG. 1, the central anomaly detection module 140 may be a stand-alone device or may be a part of the controller 600. The controller 600 may interact with the central anomaly detection module 140 to receive abnormal detection data and declare alarms. Additionally, the controller 600 may perform one or more of the operations performed by the central anomaly detection module 140.

Figure 2:
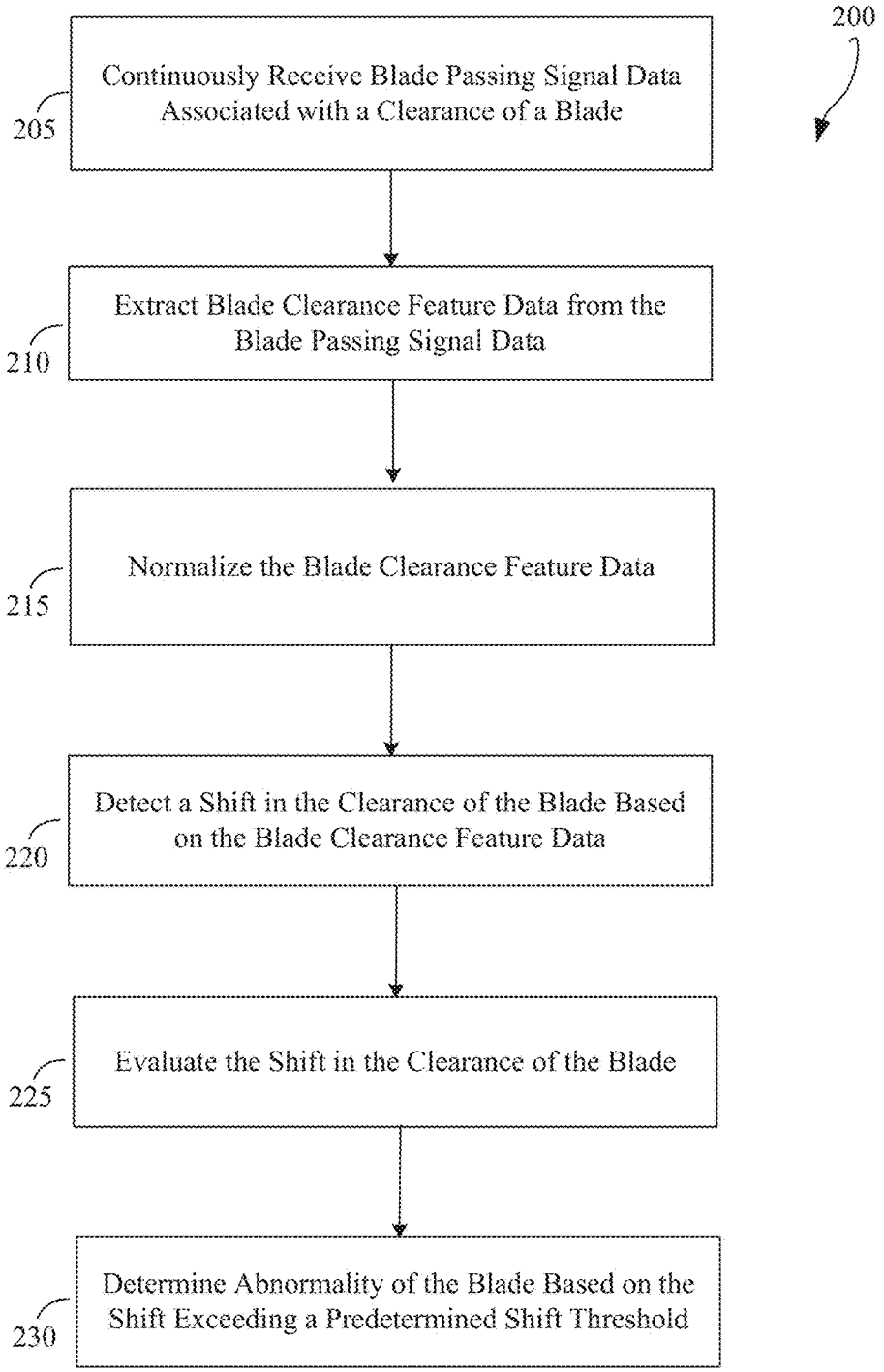
FIG. 2 is a process flow diagram illustrating an example method for blade health monitoring, in accordance with an embodiment of the disclosure.

FIG. 2 depicts a process flow diagram illustrating an example method 200 for blade health monitoring, in accordance with an embodiment of the disclosure. The method 200 may be performed by processing logic that may comprise hardware (e.g., dedicated logic, programmable logic, and microcode), software (such as software run on a general-purpose computer system or a dedicated machine), or a combination of both. In one example embodiment, the processing logic resides at a controller, such as 600 in FIGS. 1 and 6, which may reside in a user device or in a server. The controller 600 may comprise processing logic. It will be appreciated by one of ordinary skill in the art that instructions said to be executed by the controller 600 may, in fact, be retrieved and executed by one or more processors. The controller 600 may also include memory cards, servers, and/or computer disks. Although the controller 600 may be configured to perform one or more steps described herein, other control units may be utilized while still falling within the scope of various embodiments.

As shown in FIG. 2, the method 200 may commence at operation 205 with a local extraction module continuously receiving blade passing signal data associated with clearance of a blade. The clearance of the blade may be indicated by a peak voltage in the blade passing signal data. Each peak voltage in the blade passing signal data may be associated with the time of arrival of the blade at a predetermined location. For example, a peak voltage may indicate an arrival of a corresponding blade at a location of a sensing device, such as a magnetic sensor.

At operation 210, the local extraction module may preprocess the blade passing signal data by means of extracting blade clearance feature data from the blade passing signal data. Additionally, the local extraction module may smooth the blade passing signal data using a low pass filter. At operation 215, the extracted blade clearance feature data may be normalized, for example, to increase a signal-to-noise ratio. At operation 220, the normalized blade clearance feature data may be processed to detect a shift in the clearance of the blade. One of the ways to detect a shift may be a step change detection.

In some embodiments, when detecting a shift, a predefined threshold may be set. Thus, deviations below the predetermined threshold may be ignored and omitted in shift detection.

At operation 225, the detected shift in the clearance of the blade may be evaluated based on various criteria, such as confidence, persistence, and so forth. In some embodiments, a confidence level of the shift may be assessed. To this end, a two sample test may be applied to data sets related to shifts before and after the detected shift. Using this approach, the shifts exceeding a predetermined confidence level may be assessed as to whether to trigger an alarm.

At operation 230, abnormalities of the blade may be determined based on the results of the evaluation. In various embodiments, abnormalities may be determined based on the shifts exceeding certain predetermined thresholds, such as the confidence threshold, on a number of times the abnormality is detected, and so forth.

An abnormality may be related to blade damage, such as a blade cracking, a blade deformation, a blade rubbing, a blade liberation, a blade material loss, and so forth. The predetermined thresholds may be used to refine abnormality detection and eliminate minor or non-recurrent shifts.

In some embodiments, when an abnormality is determined, an alarm condition may be declared. An alarm may be declared through various means, including visual, audio, and other signals and notifications.

Figure 3:
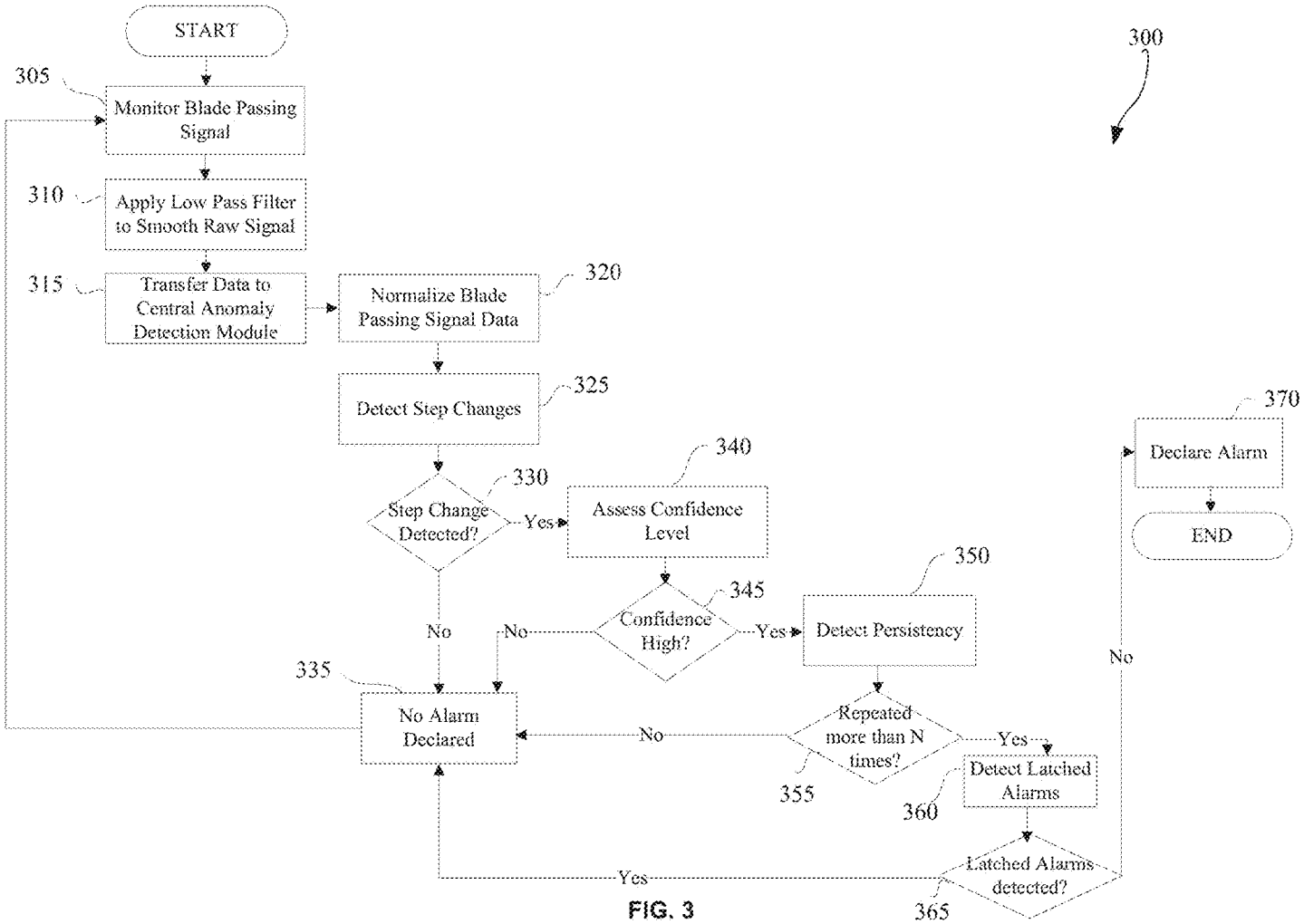
FIG. 3 is a process flow diagram illustrating an example method for blade health monitoring in detail, in accordance with an embodiment of the disclosure.

FIG. 3 depicts a process flow diagram illustrating a detailed example method 300 for blade health monitoring in a gas turbine, in accordance with an embodiment of the disclosure.

The method 300 may commence with monitoring a blade passing signal at operation 305. The blade passing signal may be monitored using a magnetic sensor to sense the signal from the blades of a gas turbine. The magnetic sensor may be installed, for example, in a wall of a turbine compressor. Based on the signal, clearance of a compressor blade may be determined In some embodiments, the clearance of the blade may be determined from a peak voltage in the blade passing signal. The clearance of the blade may be associated with the time of arrival of the blade at a predetermined location.

At operation 310, the raw signal may be smoothed using a low pass filter and pre-processed by means of extracting blade clearance feature data from the blade passing signal data. The resulting lower frequency feature data may be transferred to the central anomaly detection module at operation 315.

The central anomaly detection module may normalize the signal data frequency data to increase a signal-to-noise ratio at operation 320, and detect step changes at operation 325. Detected step changes may be associated with a blade abnormality, such as a blade cracking, a blade deformation, a blade rubbing, a blade liberation, a blade material loss, and so forth.

When no step change is detected at operation 330, alarm declaring may be suppressed at operation 335, and the method may continue from operation 305. However, when a step change (referred to as a shift) is detected at operation 330, it may be further processed to confirm the existence and/or severity of blade damage. For example, a confidence level of the shift may be assessed at operation 340. For this evaluation, data sets from the shifts before and after the detected shift may be analyzed using a two sample T-Test.

The resulting confidence level may be used to determine whether to declare an alarm for a shift at operation 345. When a confidence level of a shift is lower than a predetermined threshold, no alarm is declared at operation 335, and the method may continue with operation 305.

In some embodiments, the shifts with a high confidence level may be further processed to determine their persistency and latched alarms. At operation 350, a persistency of a shift may be detected. Only the shifts that have recurred for more than a predetermined number of times (operation 355) may be considered eligible for declaring an alarm, whereas the shifts that have recurred for a fewer number of times may be omitted in alarm declaring.

Furthermore, at operation 360, latched alarms may be detected. This allows avoiding declaring multiple alarms for the same abnormalities. Thus, when a latched alarm is detected at operation 365, no alarm is declared. However, when there are no latched alarms at operation 365, an alarm is declared at operation 370.

Figure 4:
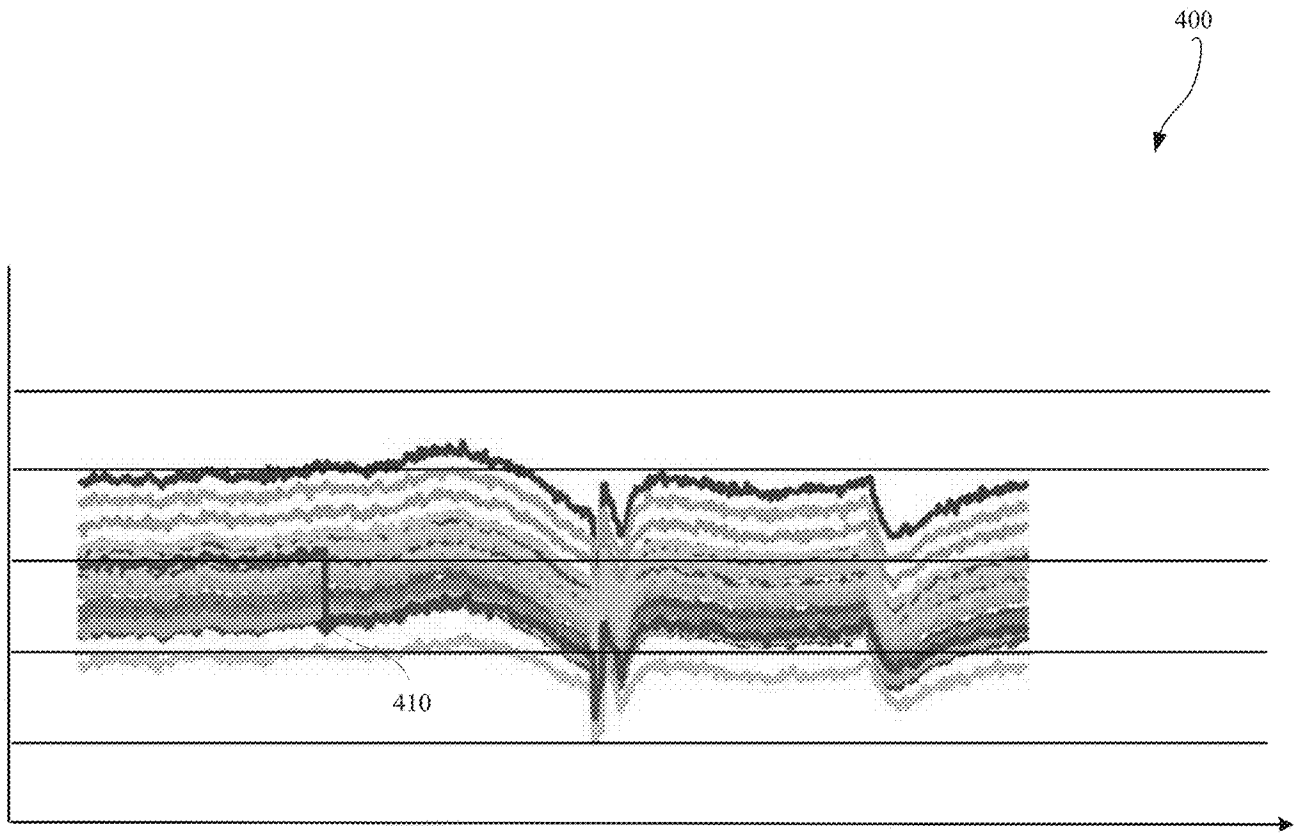
FIG. 4 illustrates an example raw data trend of tip clearance indicating blade damage, in accordance with an embodiment of the disclosure.

FIG. 4 depicts a graphical representation of raw data 400 of a blade passing signal as received by the local extraction module, in accordance with an embodiment of the disclosure. The raw data 400 may be associated with clearance of a blade indicated by a peak voltage in the blade passing signal data. The peak voltage may be evaluated in relation to the time of blade arrival at a predetermined location.

Therefore, the raw data 400 of the blade passing signal may represent blade clearance in relation to time. A step change 410 demonstrated by the blade passing signal data may be associated with a blade abnormality, such as a foreign object damage abnormality.

Figure 5:
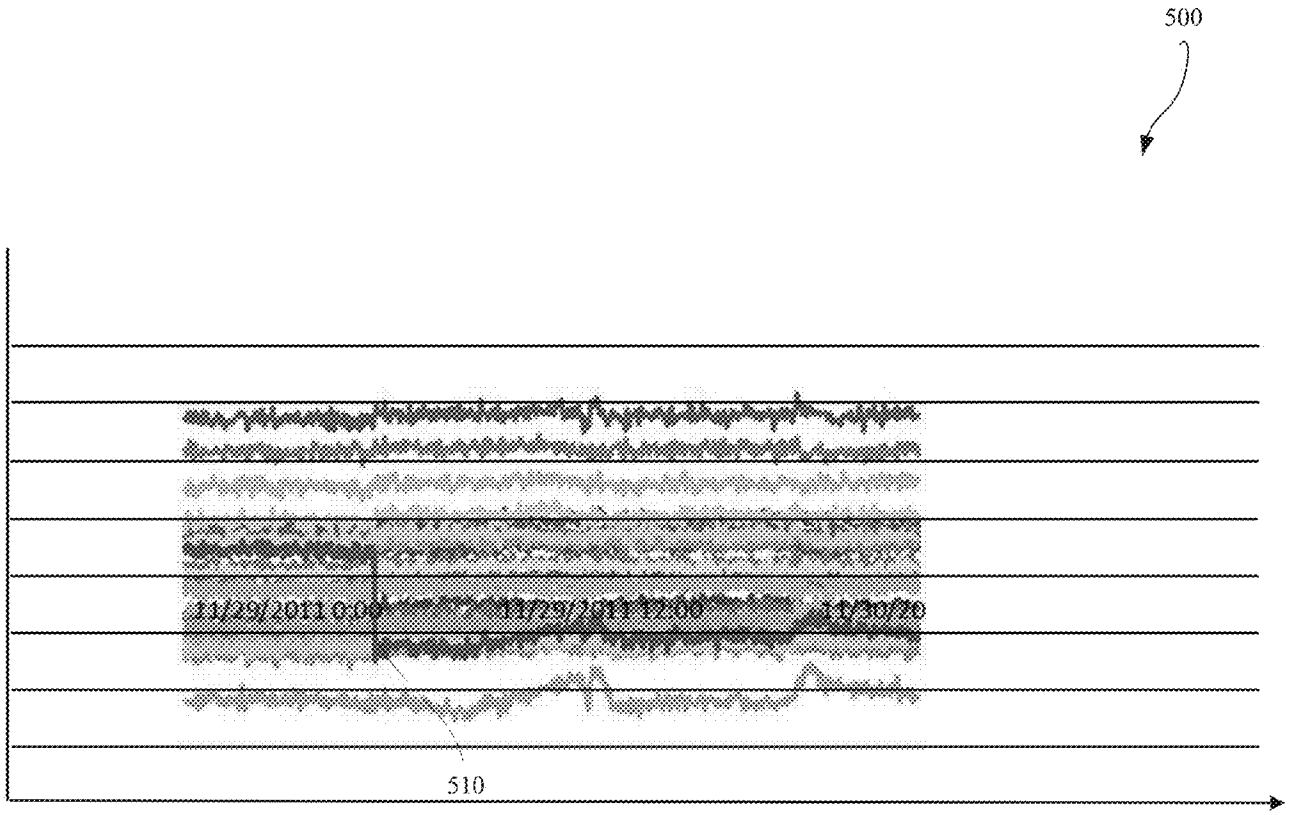
FIG. 5 illustrates an example normalized data trend of tip clearance indicating blade damage, in accordance with an embodiment of the disclosure.

FIG. 5 depicts a graphical representation of normalized signal data as processed by the central anomaly detection module, in accordance with an embodiment of the disclosure. The raw data of the blade passing signal received and pre-processed by the local extraction module may be transferred to the central anomaly detection module and normalized there to improve a signal-to-noise ratio. Normalized signal data 500 may facilitate detecting a step change 510 in tip clearance and improve the probability of detecting a minor or subtle step change. Therefore, more compressor failures may be prevented by detecting more blade damages.

Figure 6:
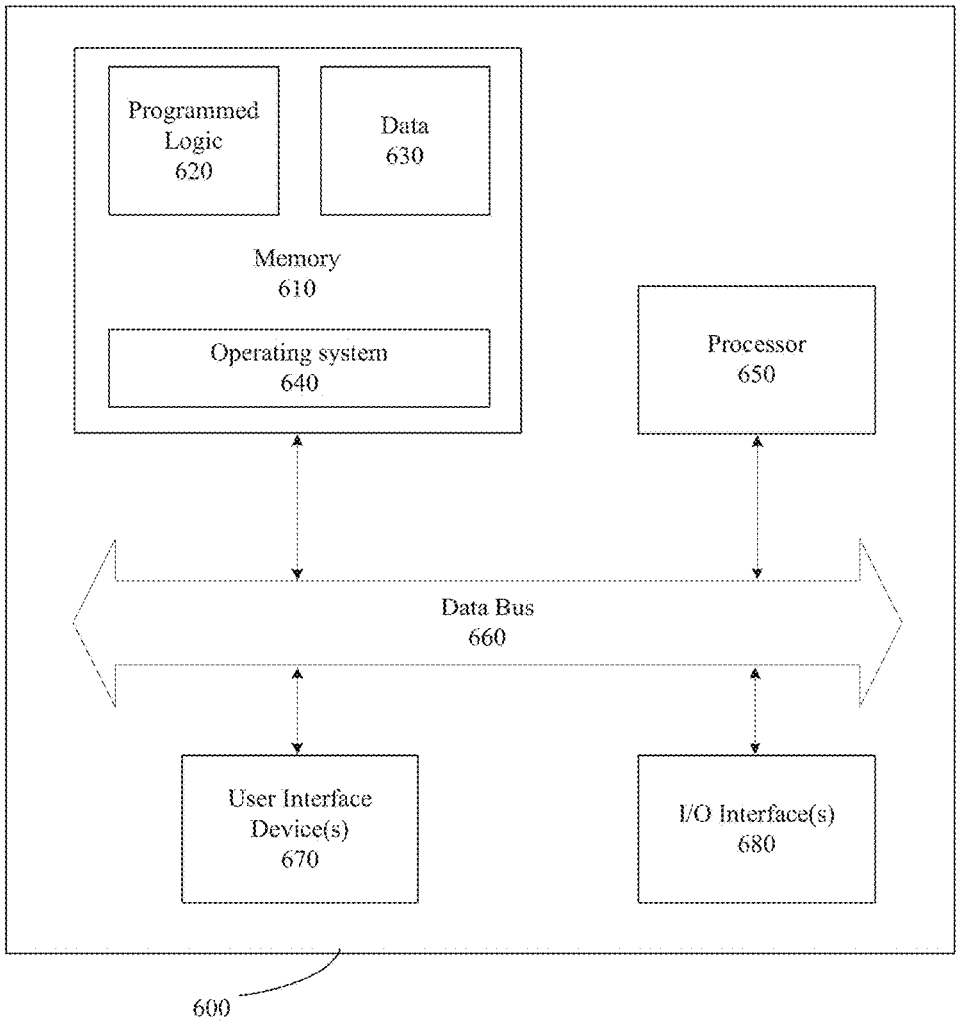
FIG. 6 is a block diagram illustrating an example controller for controlling a turbine, in accordance with an embodiment of the disclosure.

FIG. 6 depicts a block diagram illustrating a controller 600 for controlling a gas turbine for blade health monitoring, in accordance with an embodiment of the disclosure. More specifically, the elements of the controller 600 may be used to receive blade clearance feature data associated with clearance of a blade and process the data to determine its confidence, persistency, and so forth. The controller 600 may include a memory 610 that stores programmed logic 620 (e.g., software) and may store data 630, such as the blade clearance feature data, data on shifts in the clearance of the blades, and the like. The memory 610 also may include an operating system 640. A processor 650 may utilize the operating system 640 to execute the programmed logic 620, and in doing so, may also utilize the data 630. A data bus 660 may provide communication between the memory 610 and the processor 650. Users may interface with the controller 600 via at least one user interface device 670, such as a keyboard, mouse, control panel, or any other device capable of communicating data to and from the controller 600. The controller 600 may be in communication with the gas turbine online while operating, as well as in communication with the gas turbine offline while not operating, via an input/output (I/O) interface 680. More specifically, one or more of the controllers 600 may carry out the execution of the model-based control system, such as, but not limited to, continuously receive and normalize the blade clearance feature data, analyze the blade clearance feature data to detect a shift in the clearance of the blade, and determine at least one abnormality of the blade based at least in part on the shift exceeding a predetermined shift threshold. Additionally, it should be appreciated that other external devices or multiple other gas turbines may be in communication with the controller 600 via the I/O interface 680. In the illustrated embodiment, the controller 600 may be located remotely with respect to the gas turbine; however, it may be co-located or even integrated with the gas turbine. Further, the controller 600 and the programmed logic 620 implemented thereby may include software, hardware, firmware, or any combination thereof. It should also be appreciated that multiple controllers 600 may be used, whereby different features described herein may be executed on one or more different controllers 600.

References are made to block diagrams of systems, methods, apparatuses, and computer program products according to example embodiments. It will be understood that at least some of the blocks of the block diagrams, and combinations of blocks in the block diagrams, may be implemented at least partially by computer program instructions. These computer program instructions may be loaded onto a general purpose computer, special purpose computer, special purpose hardware-based computer, or other programmable data processing apparatus to produce a machine, such that the instructions which execute on the computer or other programmable data processing apparatus create means for implementing the functionality of at least some of the blocks of the block diagrams, or combinations of blocks in the block diagrams discussed.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the block or blocks.

One or more components of the systems and one or more elements of the methods described herein may be implemented through an application program running on an operating system of a computer. They also may be practiced with other computer system configurations, including handheld devices, multiprocessor systems, microprocessor based or programmable consumer electronics, mini-computers, mainframe computers, and the like.

Application programs that are components of the systems and methods described herein may include routines, programs, components, data structures, and so forth that implement certain abstract data types and perform certain tasks or actions. In a distributed computing environment, the application program (in whole or in part) may be located in local memory or in other storage. In addition, or alternatively, the application program (in whole or in part) may be located in remote memory or in storage to allow for circumstances where tasks are performed by remote processing devices linked through a communications network.

Many modifications and other embodiments of the example descriptions set forth herein to which these descriptions pertain will come to mind having the benefit of the teachings presented in the foregoing descriptions and the associated drawings. Thus, it will be appreciated the disclosure may be embodied in many forms and should not be limited to the example embodiments described above. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A method for blade health monitoring, the method comprising:

continuously receiving, from an extraction module, blade passing signal data associated with a clearance of a blade, wherein the blade passing signal data is pre-processed by the extraction module;

extracting blade clearance feature data from the blade passing signal data at a location associated with the blade;

normalizing the blade clearance feature data;

based at least in part on the blade clearance feature data, detecting a shift in the clearance of the blade;

evaluating the shift in the clearance of the blade; and determining at least one abnormality of the blade based at least in part on the shift exceeding a predetermined shift threshold.

2. The method of claim 1, where the blade passing signal data includes at least one peak voltage indicative of the clearance of the blade.

3. The method of claim 1, wherein the at least one abnormality includes one or more of a blade cracking, a blade deformation, a blade rubbing, a blade liberation, or a blade material loss.

4. The method of claim 1, wherein the blade passing signal data is associated with a time of arrival of the blade at a predetermined location.

5. The method of claim 1, wherein the normalizing of the blade passing signal data includes increasing a signal-to-noise ratio.

6. The method of claim 1, wherein the pre-processing of the blade passing signal data by the local extraction module data includes smoothing the blade passing signal data using a low pass filter.

7. The method of claim 1, further comprising analyzing persistence of the abnormality based on a number of times the abnormality is detected.

8. The method of claim 1, wherein the evaluation further includes assessing a confidence level indicative of the shift exceeding a predetermined confidence threshold.

9. The method of claim 8, further comprising declaring an alarm condition based at least in part on the confidence level exceeding the predetermined confidence threshold.

10. The method of claim 9, further comprising suppressing subsequent declarations of the alarm condition for a predetermined period of time after the declaration of the alarm condition.

11. A system for blade health monitoring, the system comprising:

a feature extraction module configured to:

continuously receive blade passing signal data associated with a clearance of a blade; and pre-process the blade passing signal data, wherein blade clearance feature data is extracted from the blade passing signal data at a location associated with the blade prior to transmission to an anomaly detection module; and the anomaly detection module, in communication with the extraction module, configured to:

normalize the blade clearance feature data received from the extraction module;

analyze the blade clearance feature data to detect a shift in the clearance of the blade; and determine at least one abnormality of the blade based at least in part on the shift exceeding a predetermined shift threshold.

12. The system of claim 11, further comprising a magnetic sensor configured to sense a blade passing signal.

13. The system of claim 12, wherein the blade passing signal is associated with at least one blade of a compressor of a gas turbine.

14. The system of claim 11, wherein the at least one abnormality includes one or more of a blade cracking, a blade deformation, a blade rubbing, a blade liberation, or a blade material loss.

15. The system of claim 11, wherein the blade passing signal data is associated with a time of arrival of a blade at a predetermined location.

16. The system of claim 11, wherein the extraction module further comprises a low pass filter configured to smooth the blade passing signal data.

17. The system of claim 11, wherein the anomaly detection module is further configured to assess a confidence level of the shift.

18. The system of claim 17, wherein the anomaly detection module is further configured to declare an alarm condition if the confidence level exceeds a predetermined confidence threshold.

19. The system of claim 11, wherein the anomaly detection module is further configured to:

analyze persistence of the abnormality based on a number of times the abnormality is repeated; and suppress repetitive declarations of the alarm condition for a predetermined period of time after the declaration of the alarm condition.

20. A system comprising:

a gas turbine compressor including a plurality of blades;

a plurality of magnetic sensors to sense blade passing signals from the plurality of blades;

an extraction module configured to:

continuously receive blade passing signal data associated with a clearance of the plurality of blades; and pre-process the blade passing signal data, wherein blade clearance feature data is extracted from the blade passing signal data at a location associated with the blade prior to transmission to an anomaly detection module; and the anomaly detection module, in communication with the local extraction module, configured to:

normalize the blade clearance feature data received from the extraction module;

analyze the blade clearance feature data to detect a shift in the clearance of the blade;

determine at least one abnormality of the blade if the shift exceeds a predetermined shift threshold;

assess a confidence level of the shift; and selectively declare an alarm condition based on the confidence level.

* * * * *